US007101276B2

(12) United States Patent
Stuckenholz et al.

(10) Patent No.: US 7,101,276 B2
(45) Date of Patent: Sep. 5, 2006

(54) ABRASIVE CUTTING-OFF WHEEL FOR STATIONARY USE

(75) Inventors: Bernd-Gunter Stuckenholz, Wiehl (DE); Dirk Isenhardt, Gummersbach (DE); Uwe Hartelt, Gummersbach (DE); Ludger Hardenbicker, Engelskirchen (DE); Hans-Albert Wenkel, Bedburg (DE)

(73) Assignee: August Ruggeberg GmbH & Co. KG, Marienheide (DE)

( * ) Notice: Subject to any disclaimer, the term of this patent is extended or adjusted under 35 U.S.C. 154(b) by 0 days.

(21) Appl. No.: 11/171,294

(22) Filed: Jul. 1, 2005

(65) Prior Publication Data

US 2006/0128292 A1 Jun. 15, 2006

(30) Foreign Application Priority Data

Jul. 3, 2004 (DE) ..... 10 2004 032 311

(51) Int. Cl.
*B24D 5/00* (2006.01)

(52) U.S. Cl. ..... 451/546; 125/15

(58) Field of Classification Search ..... 451/546, 451/541, 526; 125/15; 51/293, 298
See application file for complete search history.

(56) References Cited

U.S. PATENT DOCUMENTS 2,475,517 A * 7/1949 Ries et al. ..... 451/546
2,814,918 A * 12/1957 Erickson ..... 451/546
3,030,743 A * 4/1962 Raymond ..... 451/544
3,250,045 A * 5/1966 Caserta ..... 451/548
3,685,215 A * 8/1972 Bates ..... 451/546
3,716,950 A * 2/1973 McClure ..... 451/546
3,838,543 A * 10/1974 Lakhani ..... 451/546
4,962,748 A * 10/1990 Schweickhardt ..... 125/13.01
5,249,566 A * 10/1993 Sawluk ..... 125/15

FOREIGN PATENT DOCUMENTS

DE 2610580 9/1977
DE 4235277 4/1994
NL 044273 * 10/1938

* cited by examiner

*Primary Examiner*—Robert A. Rose
(74) *Attorney, Agent, or Firm*—Browdy and Neimark, PLLC

(57) ABSTRACT

An abrasive cutting-off wheel for stationary use is comprised of two partial abrasive wheels which are joined to each other. Each of these partial abrasive wheels comprises an interior supporting disk and a radially adjoining interior layer of abrasive grain. It further comprises an exterior layer of abrasive grain and an exterior supporting disk which is located radially there-within. A reinforcement layer is provided between the supporting disks and the layers of abrasive grain. Another reinforcement layer can be disposed between the supporting disks and the interior layers of abrasive grain.

16 Claims, 3 Drawing Sheets

ABRASIVE CUTTING-OFF WHEEL FOR STATIONARY USE

BACKGROUND OF THE INVENTION

1. Field of the Invention

The invention relates to an abrasive cutting-off wheel for stationary use.

2. Background Art

Abrasive cutting-off wheels of the generic type are used on stationary abrasive cutting-off machines, serving for severing workpieces, in particular of metal. A clearance is cut in the work being severed, corresponding to the total thickness of the abrasive cutting-off wheel. The material that is cut out constitutes a loss of material. In particular because of their large diameter, abrasive cutting-off wheels of that type must be very rigid towards side forces that act parallel to the central longitudinal axis. That is why known designs of those abrasive cutting-off wheels have a comparatively important overall thickness. Abrasive cutting-off wheels have several layers of abrasive grain which are composed of abrasive grain, binding agent and filler. Reinforcement layers are provided between the individual layers of abrasive grain, extending across the total diameter. Reinforcement layers are also disposed externally, extending only across a part of the diameter. The overall thickness of such an abrasive cutting-off wheel amounts for example to approximately 15 mm, given an outside diameter of 1250 mm. On the one hand, these known abrasive cutting-off wheels require lots of material because of their important thickness, which makes them rather costly; on the other hand, a user, when severing works, will have a comparatively high loss of material in the clearance being cut, which is not desirable.

SUMMARY OF THE INVENTION

It is an object of the invention to embody an abrasive cutting-off wheel of special rigidity towards side forces which can thus be provided with reduced overall thickness.

According to the invention, this object is attained by an abrasive cutting-off wheel for stationary use, comprising an outside diameter; a total thickness; two interior supporting disks, which are concentric of a joint central longitudinal axis, each of which have a periphery of an outside diameter; each of which have a thickness, and which are connected to each other; two interior layers of abrasive grain, which are concentric of the central longitudinal axis, which have a thickness that corresponds to the thickness of the interior supporting disks, which adjoin the periphery of the interior supporting disks, and which have an outside diameter; two reinforcement layers, which are concentric of the central longitudinal axis, each of which rests on the interior supporting disk and on the layer of abrasive grain, which are united with the interior supporting disk, and which have an outside diameter; two exterior supporting disks, which are concentric of the central longitudinal axis (10), each of which have a periphery of an outside diameter, which are united with the respective reinforcement layer, which have a thickness, and the outside diameter of which is less than the outside diameter of the interior supporting disks; and two exterior layers of abrasive grain, which are concentric of the central longitudinal axis, which have a thickness, which adjoin the periphery of the exterior supporting disks, and which have an outside diameter. The design according to the invention confers extraordinarily strong rigidity towards side forces to the abrasive cutting-off wheel; it can therefore be configured to have very little overall thickness accompanied with a very large diameter.

Further features, advantages and details of the invention will become apparent from the ensuing description of exemplary embodiments, taken in conjunction with the drawing.

DESCRIPTION OF PREFERRED EMBODIMENTS

Figure 1:
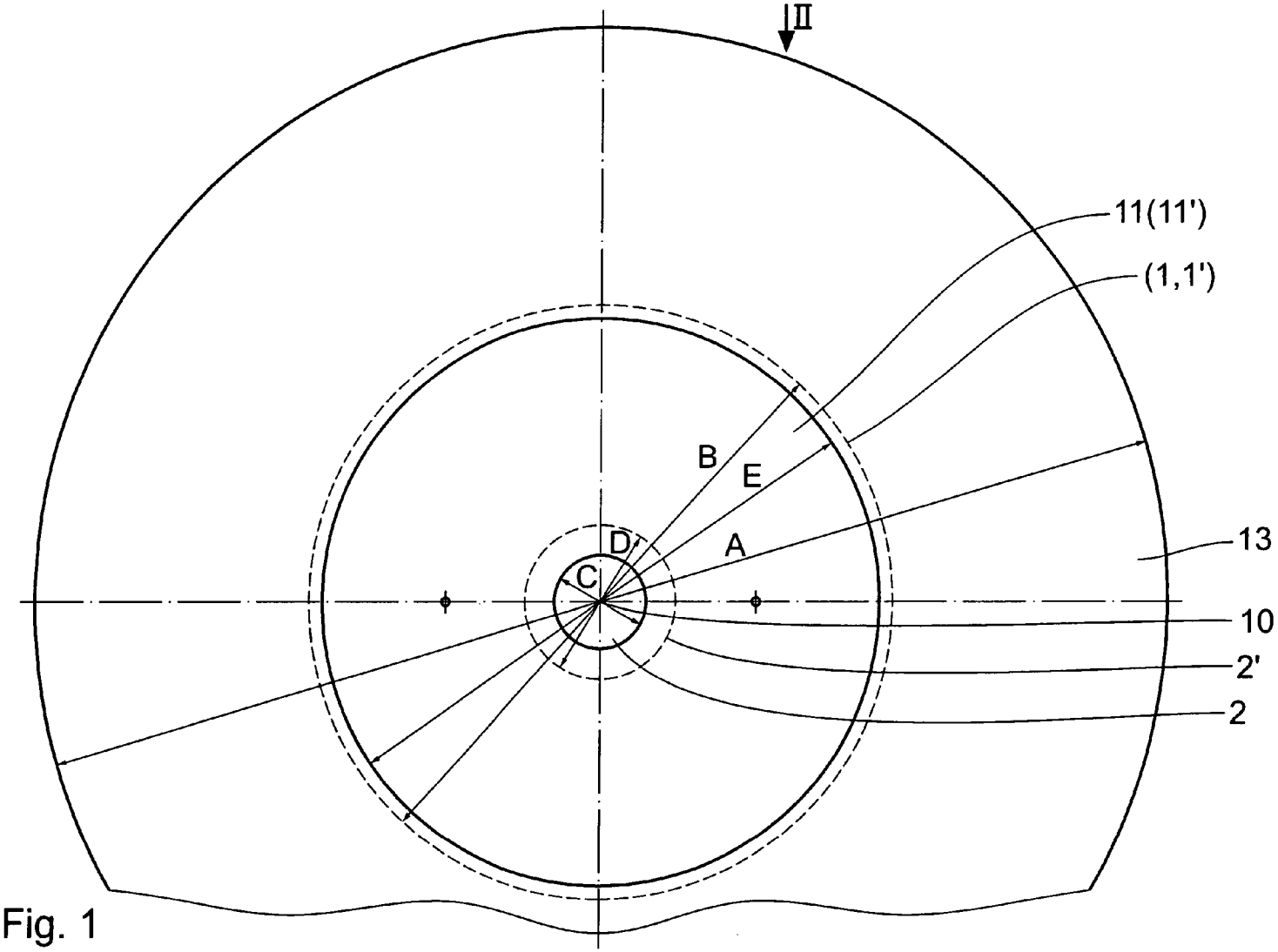
FIG. 1 is a plan view of details of an abrasive cutting-off wheel of the invention in accordance with the arrow I of FIG. 2.

As seen in the drawing, the abrasive cutting-off wheel is a wheel for use on stationary abrasive cutting-off machines i.e., an abrasive cutting-off wheel that is not used on a freely hand-operated grinding machine. It has an outside diameter A to which applies: 500 mm$\leqq$A$\leqq$1800 mm, and preferably 500 mm$\leqq$A$\leqq$1600 mm. The abrasive cutting-off wheel comprises two inner, annular cylindrical and rigid supporting disks 1, 1' as a rule of steel sheet of identical configuration which have an outside diameter B. They are identical with each other, continuously having the same thickness a. Centrally they have an opening 2 of an inside diameter C. The supporting disks 1, 1' have circular cylindrical peripheries 3, 3', from each of which an annular cylindrical interior layer of abrasive grain 4, 4' extends outwardly, likewise of the thickness a and an outside diameter A. Customarily they consist of abrasive grain 5, binding agent 6 and filler 7.

The two supporting disks 1, 1', and correspondingly the layers of abrasive grain 4, 4', bear against each other. Each of their outsides is provided with a reinforcement layer 8, 8' of a fabric, for instance glass cloth coated with a customary phenolic resin. The reinforcement layers 8 and 8', each in the form of a ring wheel, have an outside diameter A and an inner opening 2' of an inside diameter D which is definitely not less than, but may exceed, the inside diameter C of the opening 2.

Annular cylindrical, rigid, exterior supporting disks 11, 11' of steel are disposed externally on the reinforcement layers 8, 8', likewise concentrically of the joint central longitudinal axis; they too have an opening 2 of an inside diameter C. Their outside diameter E is definitely less than the outside diameter B of the interior supporting disks 1, 1', but also definitely exceeds the inside diameter D of the opening 2' of the reinforcement layers 8, 8'. This provides for sufficient lap of the interior supporting disks 1, 1' and the exterior supporting disks 11, 11' over the reinforcement layers 8, 8'.

As regards the relationship of the abrasive-cutting-off-wheel outside diameter A to the supporting-wheel-11, 11' outside diameter E, the following applies: 0.25 A$\leqq$E$\leqq$0.8 A, and preferably 0.25a$\leqq$E$\leqq$0.67 A. As for the lap of the interior supporting disks 1, 1' over the exterior supporting disks 11, 11', 0.005 A$\leqq$(B−E)<0.05A applies. D is definitely less than E so that sufficient lap is ensured of the respective supporting disk 1, 1' and 11 , 11' over the reinforcement layers 8, 8'. The reinforcement layers 8, 8' are fixedly united with the respective interior supporting disk 1, 1' by means of an adhesive layer 9, 9' and with the respective exterior supporting disk 11, 11' by means of an adhesive layer 14, 14'.

The circular cylindrical peripheries 12, 12' of the exterior supporting disks 11, 11' are each followed by an annular cylindrical exterior layer of abrasive grain 13, 13', the thickness b of which in the direction of the axis 10 exceeds the thickness c of the exterior supporting disks 11 and 11'. The layers of abrasive grain 13, 13' project axially from the exterior supporting disks 11 and 11'. The composition of the exterior layer of abrasive grain 13, 13' may fundamentally be the same as that of the interior layer of abrasive grain 4, 4'.

Figure 2:
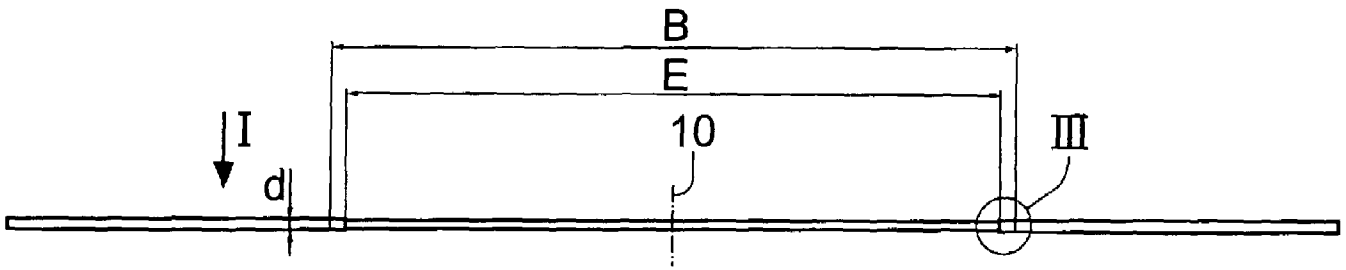
FIG. 2 is a side view of the abrasive cutting-off wheel in accordance with the arrow II of FIG. 1.

As seen in the illustration of FIGS. 1 and 2, the total thickness d of the abrasive cutting-off wheel is very restricted as compared to its outside diameter A. $0.01 \leqq d/A \leqq 0.011$ applies as an upper boundary and $0.006 \leqq d/A \leqq 0.008$ as a lower boundary.

The abrasive cutting-off wheel is produced in such a way that two identical partial abrasive wheels 15, 15' are made first. This takes place by the interior supporting disks 1 and 1', each by itself, being placed on a plane base and by the blend of abrasive grain 5, binding agent 6 and filler 7 being incorporated for forming the interior layer of abrasive grain 4 and 4' in such a way that it tightly adjoins the periphery 3 and 3'.

The respective adhesive layer 9 and 9' has been attached to the supporting disks 1, 1' beforehand. Then the reinforcement layers 8 and 8' are being placed on. Afterwards the exterior supporting disks 11 and 11', provided with the adhesive layer 14 and 14', are being placed on the reinforcement layers 8 and 8', after which the exterior layer of abrasive grain 13 and 13' is being applied in such a way that it tightly adjoins the respective pheriphery 12 and 12'. The respective partial wheels 15 and 15' are then being compacted and compressed i.e., appropriately solidified, for sufficient inherent stability. They are then being placed on each other by the two free sides of the interior supporting disks 1 and 1' and by the corresponding free inward sides of the interior layer of abrasive grain 4 and 4' after an adhesive layer 16, 16' has been applied to each of the two supporting disks 1 and 1'. The two partial abrasive wheels 15 and 15' are then being pressed together and cured in a furnace, constituting an abrasive cutting-off wheel.

Figure 3:
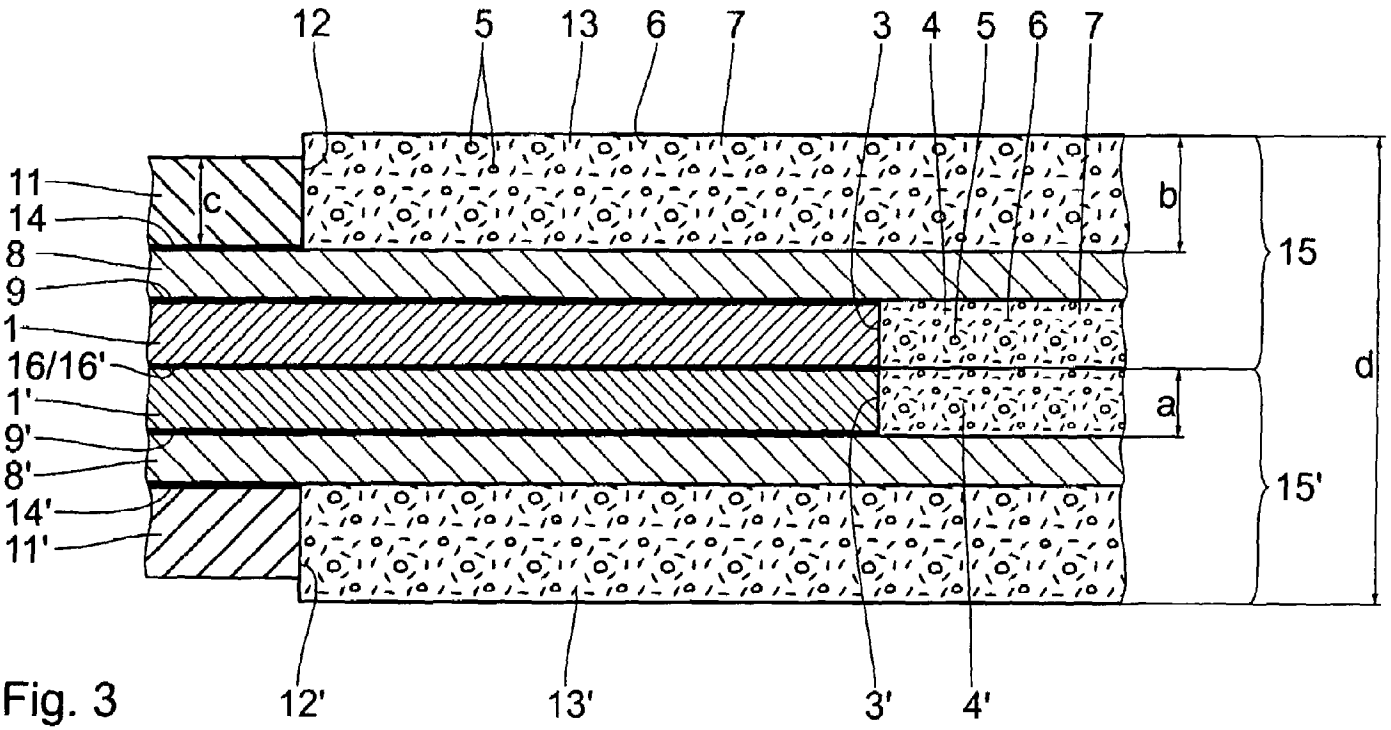
FIG. 3 is a cross-sectional view of details of the abrasive cutting-off wheel in accordance with the detail III of FIG. 2 on a strongly enlarged scale as compared to FIG. 1 and FIG. 2.
Figure 4:
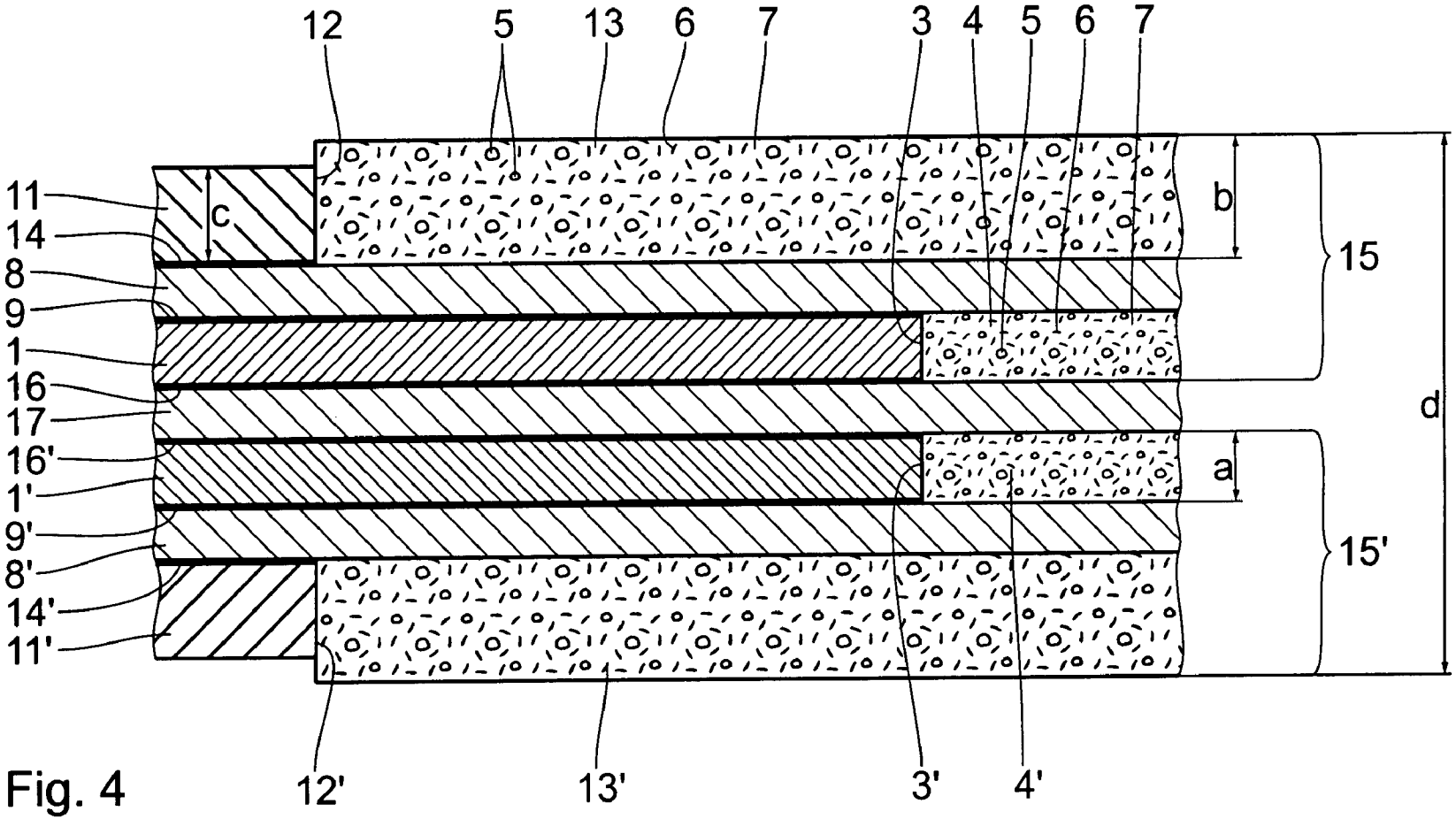
FIG. 4 is a cross-sectional view of details of an abrasive cutting-off wheel that is slightly modified as compared to the abrasive cutting-off wheel of FIG. 3.

The embodiment according to FIG. 4 differs from that according to FIG. 3 in that another reinforcement layer 17 is provided between the two partial abrasive wheels 15, 15'; it can be designed in the same way as the reinforcement layers 8, 8'. Both supporting disks 1, 1' are united with this inside reinforcement layer 17 by the respective adhesive layer 16 and 16'. Placing this additional inside reinforcement layer 17 takes place before the two partial abrasive wheels 15, 15' are assembled and subsequently compressed and cured in a furnace. The total thickness d' of this abrasive cutting-off wheel exceeds the total thickness d of the abrasive cutting-off wheel of FIG. 3 by the thickness of the reinforcement layer 17.

What is claimed is:

1. An abrasive cutting-off wheel for stationary use, comprising an outside diameter (A);

a total thickness (d);

two interior supporting disks (1, 1'), which are concentric of a joint central longitudinal axis (10), each of which have a periphery (3, 3') of an outside diameter (B);

each of which have a thickness (a), and which are connected to each other;

two interior layers of abrasive grain (4, 4'), which are concentric of the central longitudinal axis (10), which have a thickness (a) that corresponds to the thickness (a) of the interior supporting disks (1, 1'), which adjoin the periphery (3, 3') of the interior supporting disks (1, 1'), and which have an outside diameter (A);

two reinforcement layers (8, 8'), which are concentric of the central longitudinal axis (10), each of which rests on the interior supporting disk (1, 1') and on the layer of abrasive grain (4, 4'), which are united with the interior supporting disk (1, 1'), and which have an outside diameter (A);

two exterior supporting disks (11, 11'), which are concentric of the central longitudinal axis (10), each of which have a periphery (12, 12') of an outside diameter (E), which are united with the respective reinforcement layer (8, 8'), which have a thickness (c), and the outside diameter (E) of which is less than the outside diameter (B) of the interior supporting disks (1, 1'); and two exterior layers of abrasive grain (13, 13'), which are concentric of the central longitudinal axis (10), which have a thickness (b), which adjoin the periphery (12, 12') of the exterior supporting disks (11, 11'), and which have an outside diameter (A).

2. An abrasive cutting-off wheel according to claim 1, wherein it has an inside opening (2) concentrically of the central longitudinal axis (10).

3. An abrasive cutting-off wheel according to claim 1, wherein the thickness (b) of the respective exterior layer of abrasive grain (13, 13') exceeds the thickness (c) of the adjacent exterior supporting disk (11, 11').

4. An abrasive cutting-off wheel according to claim 1, wherein the outside diameters (A) of the interior layers of abrasive grain (4, 4'), of the reinforcement layers (8, 8') and of the exterior layers of abrasive grain (13, 13') are equal.

5. An abrasive cutting-off wheel according to claim 1, wherein the interior supporting disks (1, 1') are connected to each other by an adhesive layer (16).

6. An abrasive cutting-off wheel according to claim 1, wherein the reinforcement layers (8, 8') are each united with the respectively adjacent interior supporting disk (1, 1') by an adhesive layer (9, 9').

7. An abrasive cutting-off wheel according to claim 1, wherein the exterior supporting disks (11, 11') are each united with the respectively adjacent reinforcement layer (8, 8') by an adhesive layer (14, 14').

8. An abrasive cutting-off wheel according to claim 1, wherein the interior supporting disks (1, 1') and the exterior supporting disks (11, 11') are rigid.

9. An abrasive cutting-off wheel according to claim 1, wherein $500\ \text{mm} \leqq A \leqq 1800\ \text{mm}$ applies to the outside diameter (A) of the abrasive cutting-off wheel.

10. An abrasive cutting-off wheel according to claim 9, wherein 0.25 A≦E≦0.8 A applies to the relationship of the outside diameter (A) of the abrasive cutting-off wheel to the outside diameter (E) of the exterior supporting disks (11, 11').

11. An abrasive cutting-off wheel according to claim 9, wherein a top range of 0.01≦d/A≦0.011 and a bottom range of 0.006≦d/A≦0.008 applies to the relationship of the total thickness (d) to the outside diameter (A) of the abrasive cutting-off wheel.

12. An abrasive cutting-off wheel according to claim 9, wherein 0.005A≦(B−E)≦0.05 A applies to the outside diameter (B) of the interior supporting disks (1, 1'), the outside diameter (A) of the abrasive cutting-off wheel and the outside diameter (E) of the exterior supporting disks (11, 11').

13. An abrasive cutting-off wheel according to claim 1, wherein a reinforcement layer (17) is provided between the interior supporting disks (1, 1') and the interior layers of abrasive grain (4, 4'), the reinforcement layer (17) being united therewith.

14. An abrasive cutting-off wheel according to claim 8, wherein the interior supporting disks (1, 1') and the exterior supporting disks (11, 11') consist of steel sheet.

15. An abrasive cutting-off wheel according to claim 9, wherein 50 mm≦A≦1600 mm, applies to the outside diameter (A) of the abrasive cutting-off wheel.

16. An abrasive cutting-off wheel according to claim 10, wherein 0.25 A≦E≦0.67 A applies to the relationship of the outside diameter (A) of the abrasive cutting-off wheel to the outside diameter (E) of the exterior supporting disks (11, 11').

* * * * *